US009697774B2

(12) United States Patent
Yang

(10) Patent No.: US 9,697,774 B2
(45) Date of Patent: Jul. 4, 2017

(54) ORGANIC LIGHT EMITTING DISPLAY HAVING A VARIABLE POWER SUPPLY FOR ORGANIC LIGHT EMITTING DIODE SENSING AND METHOD OF DRIVING THE SAME

(71) Applicant: SAMSUNG DISPLAY CO., LTD., Yongin, Gyeonggi-Do (KR)

(72) Inventor: Jin Wook Yang, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 292 days.

(21) Appl. No.: 14/656,570

(22) Filed: Mar. 12, 2015

(65) Prior Publication Data

US 2016/0140902 A1 May 19, 2016

(30) Foreign Application Priority Data

Nov. 19, 2014 (KR) ..... 10-2014-0161646

(51) Int. Cl.
*G09G 3/32* (2016.01)
*G09G 3/20* (2006.01)
(Continued)

(52) U.S. Cl.
CPC ..... *G09G 3/3258* (2013.01); *G09G 3/3225* (2013.01); *G09G 3/2092* (2013.01);
(Continued)

(58) Field of Classification Search
CPC ..... G09G 3/02; G09G 3/3233; G09G 3/3258
See application file for complete search history.

(56) References Cited

U.S. PATENT DOCUMENTS

2006/0158402 A1* 7/2006 Nathan ..... G09G 3/3233 345/82
2011/0007067 A1* 1/2011 Ryu ..... G09G 3/3233 345/214
(Continued)

FOREIGN PATENT DOCUMENTS

KR 10-2013-0024744 A 3/2013
KR 10-2013-0038872 A 4/2013
(Continued)

*Primary Examiner* — Larry Sternbane
*Assistant Examiner* — Sepehr Azari
(74) *Attorney, Agent, or Firm* — Lewis Roca Rothgerber Christie LLP

(57) ABSTRACT

An organic light-emitting display comprises a first transistor comprising a gate electrode connected to a scan line, a first electrode connected to a data line, and a second electrode connected to a first node, a second transistor comprising a gate electrode connected to the first node, a first electrode connected to a first power supply voltage, and a second electrode connected to a third node, a third transistor comprising a gate electrode connected to a sensing control line, a first electrode connected to the data line, and a second electrode connected to the third node and an organic light-emitting device comprising an anode connected to the third node and a cathode connected to a second power supply voltage, wherein the first power supply voltage is set to a level of a sensing voltage for a period of time during which the sensing voltage is provided to the data line.

20 Claims, 8 Drawing Sheets

(51) Int. Cl.
*G09G 3/3258* (2016.01)
*G09G 3/3225* (2016.01)

(52) U.S. Cl.
CPC . *G09G 2300/08* (2013.01); *G09G 2300/0814* (2013.01); *G09G 2300/0819* (2013.01); *G09G 2300/0842* (2013.01); *G09G 2310/08* (2013.01); *G09G 2320/029* (2013.01); *G09G 2320/0223* (2013.01); *G09G 2320/043* (2013.01); *G09G 2320/045* (2013.01); *G09G 2320/08* (2013.01)

(56) References Cited

U.S. PATENT DOCUMENTS

2013/0293450 A1* 11/2013 Wu ..... G09G 3/02
345/82
2015/0348504 A1* 12/2015 Sakariya ..... G09G 3/3233
345/206

FOREIGN PATENT DOCUMENTS

KR 10-2013-0104564 A 9/2013
KR 10-2013-0107909 A 10/2013

* cited by examiner

ORGANIC LIGHT EMITTING DISPLAY HAVING A VARIABLE POWER SUPPLY FOR ORGANIC LIGHT EMITTING DIODE SENSING AND METHOD OF DRIVING THE SAME

CROSS-REFERENCE TO RELATED APPLICATION

This application claims priority to and the benefit of Korean Patent Application No. 10-2014-0161646 filed on Nov. 19, 2014 in the Korean Intellectual Property Office, the disclosure of which is incorporated herein by reference in its entirety.

BACKGROUND

1. Field

Embodiments of the present invention relate to an organic light-emitting display and a method of driving the same.

2. Description of the Related Art

Recently, various flat panel displays have been developed as alternatives to relatively heavy and bulky cathode ray tube (CRT) displays. Examples of flat panel displays include liquid crystal displays (LCD), field emission displays (FEDs), plasma display panels (PDPs), and organic light-emitting displays.

Among the flat panel displays, organic light-emitting displays display an image using organic light-emitting diodes (OLEDs) that can emit light by electron-hole recombination. Such organic light-emitting displays have features of fast response time and low power consumption. Generally, an organic light-emitting display displays a desired image by supplying an electric current corresponding to a gray level to an OLED of each pixel. However, since the OLED is degraded over time, an image of a desired luminance level cannot be displayed. The degradation of the OLED actually causes the OLED to emit light of a gradually lower luminance level for the same data signal.

To overcome this problem, a method of compensating for degradation of an OLED by extracting degradation information of the OLED from a pixel and changing data using the extracted degradation information has been suggested. In this degradation compensation method, however, a leakage current of a driving transistor may be included in the degradation information when the degradation information is extracted. Therefore, the reliability of the degradation information may be reduced.

SUMMARY

Embodiments of the present invention provide an organic light-emitting display which can measure highly reliable degradation information by suppressing the generation of a leakage current of a driving transistor.

Embodiments of the present invention also provide a method of driving an organic light-emitting display which can measure highly reliable degradation information by suppressing the generation of a leakage current of a driving transistor.

However, embodiments of the present invention are not restricted to the ones set forth herein. The above and other aspects of embodiments of the present invention will become more apparent to one of ordinary skill in the art to which the present invention pertains by referencing the detailed description of embodiments of the present invention given below.

According to an embodiment of the present invention, there is provided an organic light-emitting display including a first transistor including a gate electrode connected to a scan line, a first electrode connected to a data line, and a second electrode connected to a first node, a second transistor including a gate electrode connected to the first node, a first electrode connected to a first power supply voltage, and a second electrode connected to a third node, a third transistor including a gate electrode connected to a sensing control line, a first electrode connected to the data line, and a second electrode connected to the third node and an organic light-emitting device including an anode connected to the third node and a cathode connected to a second power supply voltage, wherein the first power supply voltage is set to a level of a sensing voltage for a period of time during which the sensing voltage is provided to the data line.

A same voltage may be applied to the gate electrode, the first electrode and the second electrode of the second transistor.

The first transistor and the third transistor may be turned on sequentially.

The first transistor and the second transistor may be turned on concurrently.

The organic light-emitting display may further include a sensor configured to read out sensing data of the organic light-emitting device corresponding to the sensing voltage.

The organic light-emitting display may further include a controller configured to receive the sensing data from the sensor and to generate compensated image data by compensating an image signal received from an external source using the sensing data.

The organic light-emitting display may further include a power supply configured to output the first power supply voltage and the second power supply voltage.

The controller may be configured to output driving signals for controlling the sensor and the power supply, and the power supply may include a switching device connected to a high-level supply terminal or a sensing-level supply terminal according to the driving signal received from the controller.

According to another embodiment of the present invention, there is provided an organic light-emitting display including a plurality of pixels, each pixel including an organic light-emitting device and a driving transistor including a first electrode connected to the organic light-emitting device, and a second electrode, a sensor configured to read out degradation information of the organic light-emitting device by applying a sensing voltage of a specific level to a gate electrode and the first electrode of the driving transistor and a power supply configured to supply a power supply voltage of a same level as that of the sensing voltage to the second electrode of the driving transistor.

Each of the pixels may further include a control transistor configured to supply the sensing voltage to the gate electrode of the driving transistor and a sensing transistor configured to supply the sensing voltage to the first electrode of the driving transistor.

The control transistor and the sensing transistor may be turned on sequentially.

The control transistor and the sensing transistor may be turned on concurrently.

The sensor may be configured to read out sensing data of the organic light-emitting device corresponding to the sensing voltage.

The organic light-emitting display may further include a controller configured to receive the sensing data from the sensor and to generate compensated image data by compensating an image signal received from an external source using the sensing data.

The controller may be configured to output driving signals for controlling the sensor and the power supply, and the power supply may include a switching device connected to a high-level supply terminal or a sensing-level supply terminal according to the driving signal received from the controller.

According to another embodiment of the present invention, there is provided a method of driving an organic light-emitting display including a plurality of pixels, each pixel including an organic light-emitting device and a driving transistor including a first electrode connected to the organic light-emitting device and a second electrode, the method including reading out degradation information of the organic light-emitting device by applying a sensing voltage of a specific level to a gate electrode and the first electrode of the driving transistor and generating compensated image data by compensating an image signal received from an external source using the degradation information, wherein a power supply voltage of a same level as that of the sensing voltage is supplied to the second electrode of the driving transistor in the reading out of the degradation information.

Each of the pixels may further include a control transistor which supplies the sensing voltage to the gate electrode of the driving transistor and a sensing transistor which supplies the sensing voltage to the first electrode of the driving transistor.

The control transistor and the sensing transistor may be turned on sequentially.

The control transistor and the sensing transistor may be turned on concurrently.

Compensated image data may be generated by compensating an image signal received from an external source using sensing data corresponding to the degradation information of the organic light-emitting device.

BRIEF DESCRIPTION OF THE DRAWINGS

The above and other aspects and features of embodiments of the present invention will become more apparent by describing in detail exemplary embodiments thereof with reference to the attached drawings, in which.

DETAILED DESCRIPTION

Figure 1:
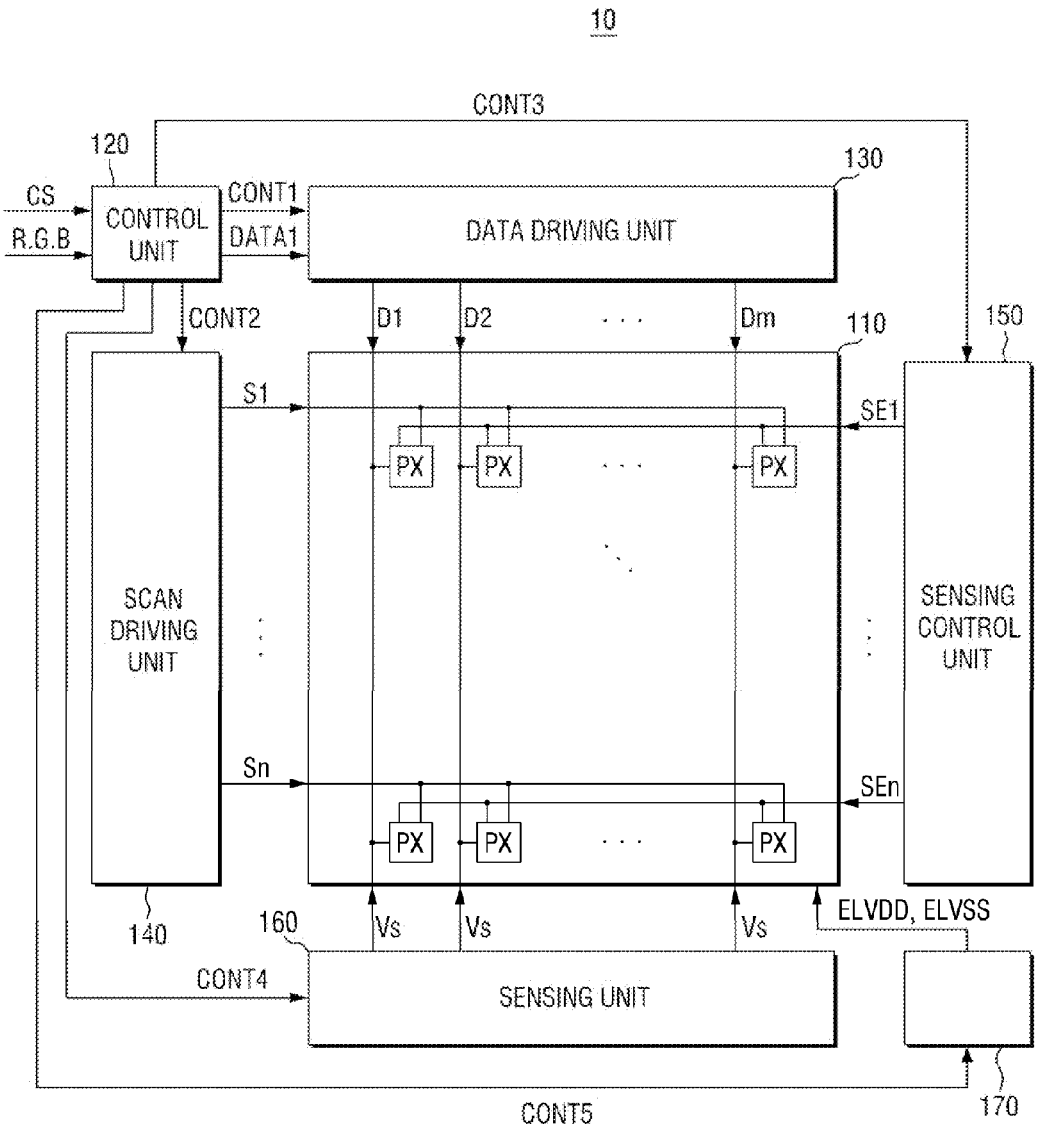
FIG. 1 is a block diagram of an organic light-emitting display according to an embodiment of the present invention.

The aspects and features of embodiments of the present invention and methods for achieving the aspects and features will be apparent by referring to the embodiments to be described in detail with reference to the accompanying drawings. However, the present invention is not limited to the embodiments disclosed hereinafter, but can be implemented in diverse forms. The matters defined in the description, such as the detailed construction and elements, are specific details provided to assist those of ordinary skill in the art in a comprehensive understanding of the present invention, and the present invention is only defined within the scope of the appended claims and their equivalents.

The term "on" that is used to designate that an element is on another element or located on a different layer or a layer includes both a case where an element is located directly on another element or a layer and a case where an element is located on another element via another layer or still another element. Throughout the description of embodiments of the present invention, the same drawing reference numerals are used for the same elements across various figures.

Although the terms "first, second, and so forth" are used to describe diverse constituent elements, such constituent elements are not limited by the terms. The terms are used only to discriminate a constituent element from other constituent elements. Accordingly, in the following description, a first constituent element may be a second constituent element. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the singular forms "a" and "an" are intended to include the plural forms as well, unless the context clearly indicates otherwise. It will be further understood that the terms "comprises," "comprising," "includes," "including," and "include," when used in this specification, specify the presence of stated features, integers, steps, operations, elements, and/or components, but do not preclude the presence or addition of one or more other features, integers, steps, operations, elements, components, and/or groups thereof.

As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent to" another element or layer, it can be directly on, connected to, coupled to, or adjacent to the other element or layer, or one or more intervening elements or layers may be present. In contrast, when an element or layer is referred to as being "directly on," "directly connected to", "directly coupled to", or "immediately adjacent to" another element or layer, there are no intervening elements or layers present.

As used herein, the term "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

The organic light emitting display and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the organic light emitting display may be formed on one integrated circuit (IC) chip or on separate IC chips. Further, the various components of the organic light emitting display may be implemented on a flexible printed circuit film, a tape carrier package (TCP), a printed circuit board (PCB), or formed on a same substrate as the organic light emitting display. Further, the various components of the organic light emitting display may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

Hereinafter, embodiments of the present invention will be described with reference to the attached drawings.

Figure 2:
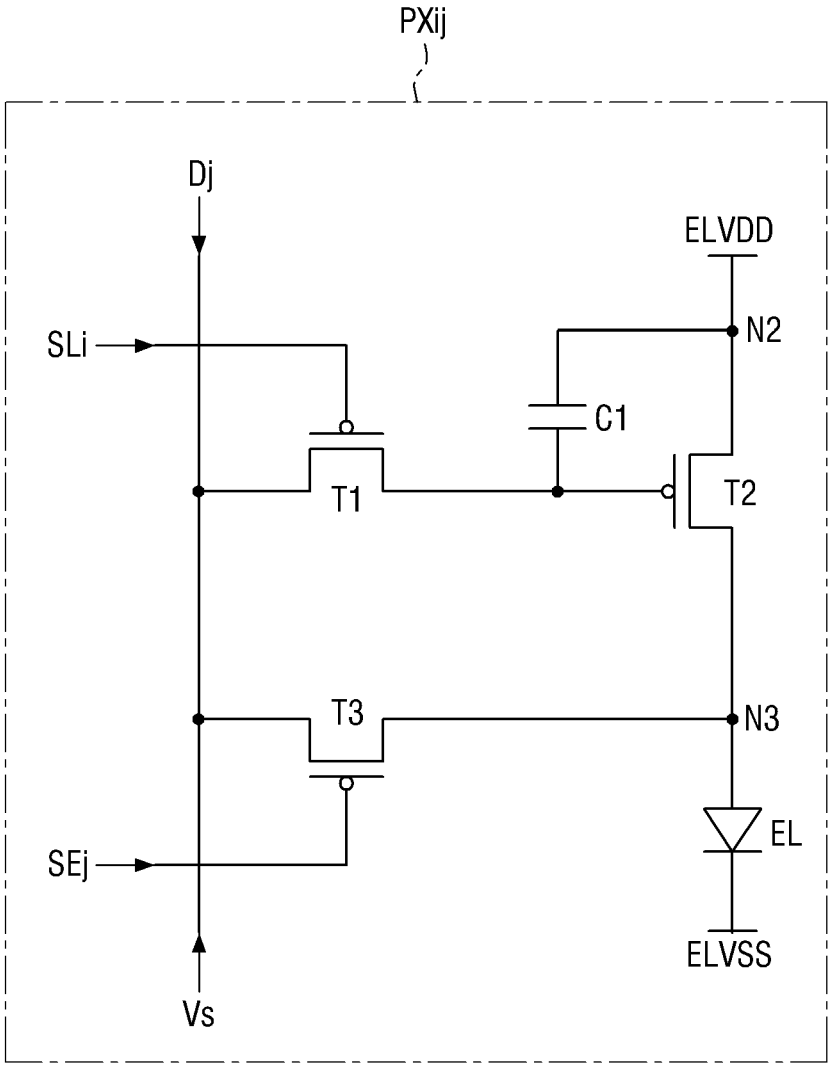
FIG. 2 is a circuit diagram of an example of a pixel according to an embodiment of the present invention.

FIG. 1 is a block diagram of an organic light-emitting display 10 according to an embodiment of the present invention. FIG. 2 is a circuit diagram of an example of a pixel according to an embodiment of the present invention.

Referring to FIGS. 1 and 2, the organic light-emitting display 10 includes a display unit (or a display) 110, a control unit (or a controller) 120, a data driving unit (or a data driver) 130, a scan driving unit (or a scan driver) 140, a sensing control unit (or a sensing controller) 150, a sensing unit (or a sensor) 160, and a power supply unit (or a power supply) 170.

The display 110 may be an area where an image is displayed. The display 110 may include a plurality of scan lines, a plurality of data lines crossing the scan lines, and a plurality of pixels PX defined by the scan lines and the data lines. Each of the data lines may cross the scan lines. The pixels PX may be arranged in a matrix. The data lines may extend along a column direction, and the scan lines may extend along a row direction. The display 110 may further include a plurality of power supply lines and a plurality of sensing control lines. Each of the power supply lines and each of the sensing control lines may be connected to a corresponding pixel.

The controller 120 may receive a control signal CS and an image signal R, G, and B from an external system. The image signal R, G, and B contains luminance information of the pixels PX. Luminance may have a fixed number of gray levels such as 1024, 256, or 64 gray levels. The control signal CS may include a vertical synchronization signal Vsync, a horizontal synchronization signal Hsync, a data enable signal DE and a clock signal CLK. The controller 120 may generate first through fifth driving signals CONT1 through CONT5 and image data DATA according to the image signal R, G, and B and the control signal CS. The controller 120 may generate the image data DATA by dividing the image signal R, G, and B on a frame-by-frame basis according to the vertical synchronization signal Vsync and dividing the image signal R, G, and B on a scan line-by-scan line basis according to the horizontal synchronization signal Hsync. The controller 120 may compensate the image data DATA and transmit the compensated image data DATA1 to the data driver 130 together with the first driving signal CONT1. The generation of the compensated image data DATA1 will be described in greater detail later. The controller 120 may transmit the second driving signal CONT2 to the scan driver 140, the third driving signal CONT3 to the sensing controller 150, the fourth driving signal CONT4 to the sensor 160, and the fifth driving signal CONT5 to the power supply 170.

The scan driver 140 may be connected to the scan lines of the display 110 and generate a plurality of scan signals S1 through Sn according to the second driving signal CONT2. The scan driver 140 may sequentially transmit the scan signals S1 through Sn of a gate-on voltage to the scan lines.

The data driver 130 may be connected to the data lines of the display 110 and generate a plurality of data voltages D1 through Dm by sampling and holding the compensated image data DATA1 and changing the compensated image data DATA1 to analog voltages according to the first driving signal CONT1. The data driver 130 may transmit the data voltages D1 through Dm to the data lines, respectively. Each pixel PX of the display 110 may be turned on by a scan signal (S1, S2, . . . , Sn) of the gate-on voltage and receive a data voltage (D1, D2, . . . , Dm).

The sensor 160 may generate a sensing voltage Vs of a specific level according to the fourth driving signal CONT4 and supply the sensing voltage Vs to the pixels PX. The sensing voltage Vs may drive an organic light-emitting device EL of each pixel PX at a specific gray level. The sensor 160 may provide the sensing voltage Vs to the data lines. In other words, the sensing voltage Vs may be provided to the pixels PX via the data lines. When the sensor 160 provides the sensing voltage Vs, wiring lines which output the data voltages D1 through Dm may be disconnected from the data lines.

The power supply 170 may provide a first power supply voltage ELVDD and a second power supply voltage ELVSS to the power supply lines connected to the pixels PX. The first power supply voltage ELVDD and the second power supply voltage ELVSS may generate a driving current for each pixel PX. The power supply 170 may determine the level of the first power supply voltage ELVDD according to the fifth driving signal CONT5. In other words, the level of the first power supply voltage ELVDD may be different in a general operating mode of a display device and in a sensing mode in which degradation information is read out. This will be described in greater detail later.

The sensing controller 150 may determine levels of sensing control signals SE1 through SEn according to the third driving signal CONT3 and provide the sensing control signals SE1 through SEn to the sensing control lines connected to the pixels PX. Here, the sensing controller 150 may sequentially provide the sensing control signals SE1 through SEn to the sensing control lines connected thereto.

FIG. 2 is a diagram schematically illustrating the circuit configuration of any one of the pixels PX included in the display 110. In other words, a pixel PXij connected to an $i^{th}$ scan line SLi and a $j^{th}$ data line DLj is illustrated as an example. However, the circuit configuration of each pixel PX is not limited to the one illustrated in FIG. 2.

Referring to FIG. 2, the pixel PXij may include a first transistor T1, a second transistor T2, a third transistor T3, a first capacitor C1, and an organic light-emitting device EL.

The first transistor T1 may include a gate electrode connected to the scan line SLi, a first electrode connected to the data line DLj, and a second electrode connected to a first node N1. The first transistor T1 may be turned on by a scan signal Si of the gate-on voltage which is transmitted to the scan line SLi. The turned-on first transistor T1 may deliver a data voltage Dj applied to the data line DLj to the first node N1. The first transistor T1 may be a switching transistor which selectively provides the data voltage Dj to a driving transistor. Here, the first transistor T1 may be a p-channel field effect transistor. In other words, the first transistor T1 may be turned on by a scan signal of a low-level voltage and turned off by a scan signal of a high-level voltage.

The second transistor T2 may include a gate electrode connected to the first node N1, a first electrode connected to a second node N2, and a second electrode connected to a third node N3. Here, the second node N2 may be connected to the first power supply voltage ELVDD. The first capacitor C1 may be located between the first node N1 and the second node N2. A data voltage provided by the first transistor T1 may be charged in the first capacitor C1, and the charged data voltage may be supplied to the gate electrode of the second transistor T2. An anode of the organic light-emitting device EL may be connected to the third node N3. The second transistor T2 may be a driving transistor and control a driving current supplied from the first power supply voltage ELVDD to the organic light-emitting device EL according to the voltage of the first node N1.

The third transistor T3 may include a gate electrode connected to a sensing control line SELi, a first electrode connected to the data line DLj, and a second electrode connected to the third node N3. The third transistor T3 may be turned on by a sensing control signal SEi of the gate-on voltage which is transmitted to the sensing control line SELi. Here, the third transistor T3 may be a sensing transistor. In other words, the sensing voltage Vs may be applied to the third node N3 via the third transistor T3. In other words, the third transistor T3 may be turned on in the sensing mode to supply the sensing voltage Vs received through the data line DLj to the third node N3.

The organic light-emitting device EL may include the anode connected to the third node N3, a cathode connected to the second power supply voltage ELVSS, and an organic light-emitting layer. The organic light-emitting layer may emit light of one of primary colors. The primary colors may be three primary colors such as red, green and blue. The spatial or temporal sum of the three primary colors may produce a desired color. The organic light-emitting layer may include low molecular weight organic matter or polymer organic matter corresponding to each color. The organic matter corresponding to each color may emit light according to the amount of electric current flowing through the organic light-emitting layer. A sensing operation according to the current embodiment will now be described in greater detail with reference to FIGS. 3 through 7.

Figure 3:
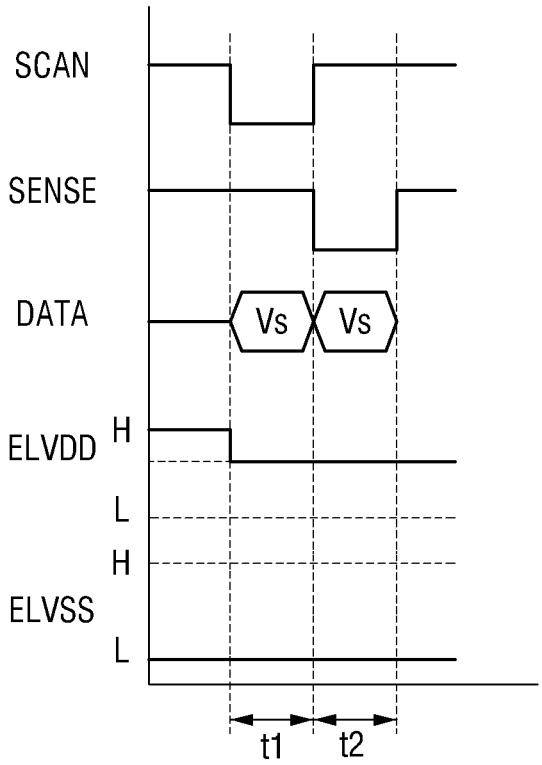
FIG. 3 is a timing diagram of a sensing mode according to an embodiment of the present invention.
Figure 4:
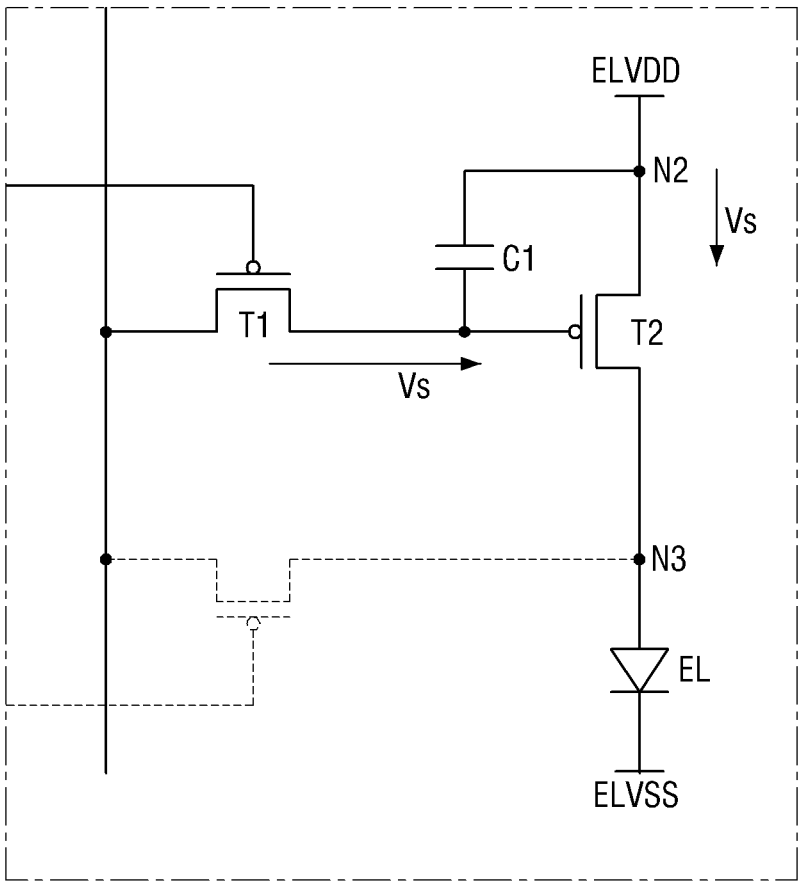
FIG. 4 is a diagram schematically illustrating the operation of a pixel in a first period.
Figure 5:
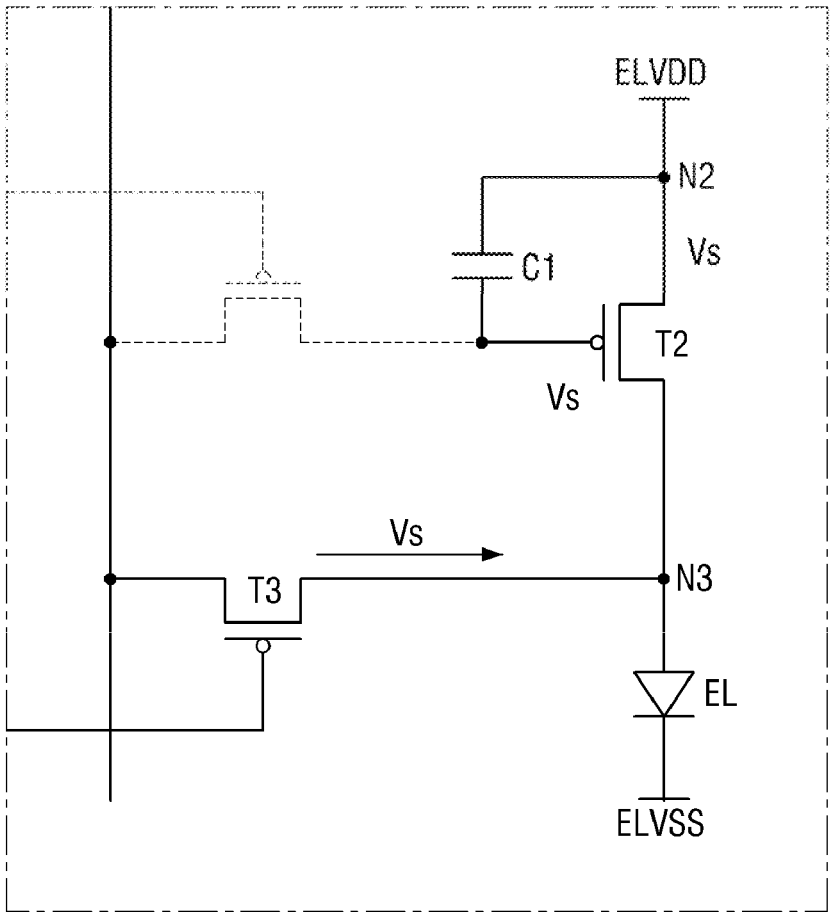
FIG. 5 is a diagram illustrating the operation of the pixel in a second period.
Figure 6:
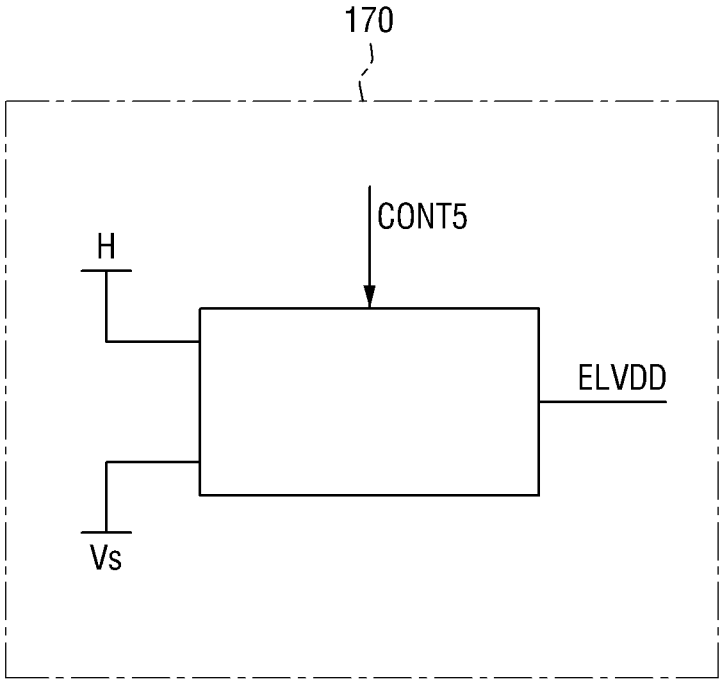
FIG. 6 is a block diagram of a power supply according to an embodiment of the present invention.
Figure 7:
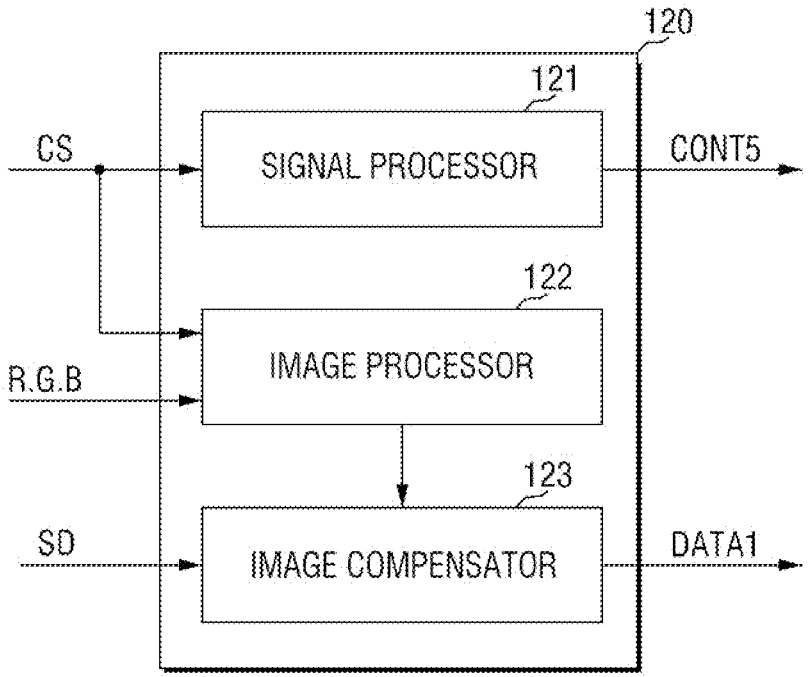
FIG. 7 is a block diagram of a controller according to an embodiment of the present invention.

FIG. 3 is a timing diagram of a sensing mode according to an embodiment of the present invention. FIG. 4 is a diagram schematically illustrating the operation of a pixel in a first period t1. FIG. 5 is a diagram illustrating the operation of the pixel in a second period t2. FIG. 6 is a block diagram of the power supply 170 illustrated in FIG. 1. FIG. 7 is a block diagram of the controller 120 illustrated in FIG. 1.

Referring to FIGS. 3 through 7, the organic light-emitting display 10 according to the current embodiment can detect degradation information of the organic light-emitting device EL included in each pixel PX. In other words, the organic light-emitting display 10 may include a sensing mode for detecting the degradation information of the organic light-emitting device EL. The sensing mode may be activated at specific intervals or by a user's setting during the operation of the organic light-emitting display 10. In other words, the degradation information of the organic light-emitting device EL may be detected in real time based on the sensing voltage Vs applied while the organic light-emitting display 10 is displaying images. However, the present invention is not limited thereto, and the sensing mode may be activated while the power of the organic light-emitting display 10 is turned off or turned on. In other words, the sensing mode may be activated during a standby time when the power is turned on or off. After the sensing mode is activated, the controller 120 may supply the first through fifth driving signals CONT1 through CONT3 to corresponding components, thereby inducing a driving process which will be described later.

The sensing mode may include a step of applying the sensing voltage Vs and a step of reading out sensing data SD. FIG. 3 is a timing diagram of the step of applying the sensing voltage Vs. In the sensing mode, the data driver 130 may be disconnected from the data lines of the display 110. In other words, the data lines may be connected to the sensor 160, and the sensing voltage Vs may be provided to each data line. However, the present invention is not limited thereto. In some embodiments, the sensing voltage Vs may be applied to the display 110 not through the data lines but through lines other than the data lines. Here, the sensing voltage Vs may be a voltage of a specific level, and the organic light-emitting device EL may emit light of a luminance level corresponding to an electric current generated by a difference between the sensing voltage Vs and the second power supply voltage ELVSS.

The step of applying the sensing voltage Vs according to the current embodiment may include the first period t1 and the second period t2. The first period t1 may be a period of time during which the second transistor T2 (i.e., the driving transistor) is completely shut off, and the second period t2 may be a period of time during which a voltage difference is created between the terminals of the organic light-emitting device EL by applying the sensing voltage Vs to the third node N3. The first period t1 may be a period of time during which the first transistor T1 is turned on, and the second period t2 may be a period of time during which the third transistor T3 is turned on. In other words, the first transistor T1 and the third transistor T3 may be turned on sequentially.

More specifically, the second transistor T2 (i.e., the driving transistor) may be completely turned off in the first period t1. Therefore, the flow of a leakage current generated by the operation of the second transistor T2 to the organic light-emitting device EL may be prevented or reduced in advance. Specifically, in the first period t1, the same or substantially the same voltage may be applied to the gate electrode and the first electrode of the second transistor T2. The sensing voltage Vs of a specific level may be supplied to the gate electrode of the second transistor T2. In other words, in the first period t1, the first transistor T1 may be turned on by a scan signal and deliver the sensing voltage Vs received through the data line DLj to the gate electrode of the second transistor T2. The gate electrode of the second transistor T2 may be charged with the sensing voltage Vs. The sensing voltage Vs may be a voltage that turns off the second transistor T2. In other words, the second transistor T2 (i.e., the driving transistor) may be turned off by the sensing voltage Vs. The second transistor T2 is turned off during the first period t1, and thus the generation of the leakage current may be prevented or reduced. Referring to FIG. 4, a voltage of the same or substantially the same level as that of the sensing voltage Vs may be provided to the second node N2 to which the first electrode of the first transistor T1 is connected. In other words, the level of the first power supply voltage ELVDD connected to the second node N2 may be set to the level of the sensing voltage Vs.

Referring to FIG. 6, the power supply 170 may selectively supply a voltage of a high level H and a voltage of the same or substantially the same level as that of the sensing voltage Vs to the first power supply voltage ELVDD. The power supply 170 may switch the level of a voltage supplied to the first power supply voltage ELVDD according to the fifth driving signal CONT5. The power supply 170 may include a switching device that is controlled according to the fifth driving signal CONT5. The switching device may be connected to a high-level voltage supply terminal or a sensing voltage-level voltage supply terminal according to the fifth driving signal CONT5.

The first power supply voltage ELVDD may be at the high level H until the sensing mode is activated. In other words, the first power supply voltage ELVDD may maintain the high level H such that a voltage difference is created between the terminals of the second transistor T2 (i.e., the driving transistor). However, when the sensing mode is activated, the level of the first power supply voltage ELVDD may be set to the level of the sensing voltage Vs. Since the sensing voltage Vs is supplied to the third node N3 in the second period t2, it may be applied to both the first and second electrodes of the second transistor T2 (i.e., the driving transistor). In other words, a voltage difference between the first and second electrodes of the second transistor T2 may be 0 V. Accordingly, the generation of an electric current by the second transistor T2 may be completely or substantially prevented.

Referring to FIG. 5, the sensing voltage Vs may be applied to the third node N3 in the second period t2. In the second period t2, the third transistor T3 may be turned on by a sensing control signal, and the sensing voltage Vs supplied through the data line DLj may be provided to the third node N3 through the third transistor T3. The third node N3 may be connected to the second electrode of the second transistor T2 (i.e., the driving transistor) and the anode of the organic light-emitting device EL. In the third node N3, an electric potential of the same or substantially the same level as that of the sensing voltage Vs may be formed. Thus, the third node N3 may have the same or substantially the same voltage as the second node N2. Accordingly, a voltage difference between the first and second electrodes of the second transistor T2 (i.e., the driving transistor) may be substantially 0 V, and the generation of the leakage current by the second transistor T2 may be completely or substantially prevented as described above. Since the first electrode of the organic light-emitting device EL is connected to the third node N3 and the second electrode of the organic light-emitting device EL is connected to the second power supply voltage ELVSS, a specific voltage difference may be created between both terminals of the organic light-emitting device EL. Accordingly, an electric current corresponding to this voltage difference may flow through the organic light-emitting device EL, causing the organic light-emitting device EL to emit light at a specific luminance level. In the sensing mode, the organic light-emitting device EL emits light at a low luminance level for a very short period of time. Therefore, even if the sensing mode is activated during the normal operation of the organic light-emitting display 10, a luminance change due to the sensing mode is not substantially visible to a user.

The sensor 160 may read out the sensing data SD. The sensing data SD may be detected using one or more of various suitable known methods. For example, the sensing data SD may be read out by measuring the luminance of the organic light-emitting device EL. However, the present invention is not limited thereto, and the sensing data SD may also be read out by measuring a current or voltage flowing through the organic light-emitting device EL. The sensor 160 may convert the read-out sensing data SD into a digital value. The digital value generated by each pixel PX may be mapped to a memory unit (or memory) and provided to the controller 120 as the sensing data SD.

Referring to FIG. 7, the controller 120 may generate the compensated image data DATA1 by compensating the image data DATA using the received sensing data SD. The controller 120 may include a signal processor 121 which generates the first through fifth driving signals CONT1 through CONT5, an image processor 122 which generates the image data DATA by processing the image signal R, G, and B, and an image compensator 123 which compensates the image data DATA. The image compensator 123 may generate the compensated image data DATA1 using the sensing data SD provided by the sensor 160 and the image data DATA provided by the image processor 122. The compensated image data DATA1 may be data obtained by compensating for the degradation of the organic light-emitting device EL of each pixel PX. The image compensator 123 may generate the compensated image data DATA1 by correcting the image data DATA such that a voltage increased by an amount corresponding to a luminance reduction caused by the degradation of the organic light-emitting device EL may be applied to a degraded pixel.

The organic light-emitting display 10 according to the current embodiment may prevent or substantially prevent the second transistor T2 (i.e., the driving transistor) from generating the leakage current by completely shutting off the second transistor T2. Accordingly, the degradation information of the organic light-emitting device EL may be read out more accurately based on the sensing voltage Vs, making more accurate data compensation possible.

An organic light-emitting display according to another embodiment of the present invention will now be described.

Figure 8:
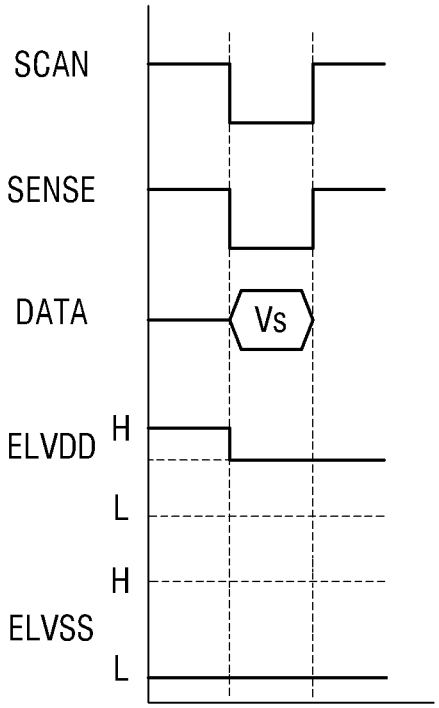
FIG. 8 is a timing diagram of a sensing mode of an organic light-emitting display according to another embodiment of the present invention.

FIG. 8 is a timing diagram of a sensing mode of an organic light-emitting display according to another embodiment of the present invention. The organic light-emitting display according to the current embodiment is different from the organic light-emitting display 10 of FIGS. 1 through 7 in that a scan signal and a sensing control signal are transmitted concurrently (e.g., simultaneously). For simplicity, a description of components substantially identical to those of the previous embodiment may be omitted, and the current embodiment will hereinafter be described, focusing mainly on differences with the previous embodiment.

In the organic light-emitting display according to the current embodiment, the scan signal and the sensing control signal may be provided at the same or substantially the same time. In other words, a first transistor T1 and a third transistor T3 may be turned on concurrently (e.g., simultaneously). Since a sensing voltage Vs is supplied through the same data line, a gate electrode of a second transistor T2 may be diode-connected to a second electrode of the second transistor T2. However, the level of a first power supply voltage ELVDD may be set to the level of the sensing voltage Vs at the same or substantially the same time as when the first transistor T1 and the third transistor T3 are turned on. In other words, voltage levels of the gate electrode, a first electrode and the second electrode of the second transistor T2 (i.e., a driving transistor) may all be set to the level of the sensing voltage Vs. Accordingly, the generation of an electric current by the second transistor T2 may be completely or substantially prevented, thus preventing or reducing a leakage current from flowing to an organic light-emitting device EL. The organic light-emitting display according to the current embodiment may turn off the driving transistor by concurrently (e.g., simultaneously) applying the same or substantially the same voltage to the gate electrode, the first electrode and the second electrode of the driving transistor. Therefore, the time required to apply the sensing voltage Vs may be reduced.

A method of driving an organic light-emitting display according to an embodiment of the present invention will now be described.

The method of driving the organic light-emitting display according to the current embodiment of the present invention includes applying a sensing voltage (operation S110) and generating compensated image data (operation S120).

Here, the organic light-emitting display includes a plurality of pixels PX, each including an organic light-emitting device EL and a second transistor T2 (i.e., a driving transistor) having a first electrode connected to the organic light-emitting device EL. The organic light-emitting display may be the organic light-emitting display 10 of FIGS. 1 through 7, and thus a detailed description thereof will be omitted. In addition, FIGS. 1 through 7 will be referred to for the description of the current embodiment.

First, a sensing voltage is applied (operation S110).

The duration of applying of the sensing voltage (operation S110) may include a first period t1 and a second period t2. The first period t1 may be a period of time during which the second transistor T2 (i.e., the driving transistor) is completely shut off, and the second period t2 may be a period of time during which a voltage difference is created between both terminals of the organic light-emitting device EL by applying a sensing voltage Vs to a third node N3. The first period t1 may be a period of time during which a first transistor T1 is turned on, and the second period t2 may be a period of time during which a third transistor T3 is turned on. In other words, the first transistor T1 and the third transistor T3 may be turned on sequentially.

In the first period t1, the second transistor T2 (i.e., the driving transistor) may be completely turned off. Specifically, in the first period t1, the same or substantially the same voltage may be applied to a gate electrode and the first electrode of the second transistor T2. The sensing voltage Vs of a specific level may be supplied to the gate electrode of the second transistor T2. In other words, in the first period t1, the first transistor T1 may be turned on by a scan signal and deliver the sensing voltage Vs received through a data line DLj to the gate electrode of the second transistor T2. The gate electrode of the second transistor T2 may be charged with the sensing voltage Vs. The sensing voltage Vs may be a voltage that turns off the second transistor T2. In other words, the second transistor T2 (i.e., the driving transistor) may be turned off by the sensing voltage Vs. Here, a voltage of the same or substantially the same level as that of the sensing voltage Vs may be provided to a second node N2 to which a first electrode of the first transistor T1 is connected. In other words, the level of a first power supply voltage ELVDD connected to the second node N2 may be set to the level of the sensing voltage Vs. The first power supply voltage ELVDD may be at a high level H until a sensing mode is activated. In other words, the first power supply voltage ELVDD may maintain the high level H such that a voltage difference is created between the terminals of the second transistor T2 (i.e., the driving transistor). However, when the sensing mode is activated, the level of the first power supply voltage ELVDD may be set to the level of the sensing voltage Vs. Since the sensing voltage Vs is supplied to the third node N3 in the second period t2, it may be applied to both the first and second electrodes of the second transistor T2 (i.e., the driving transistor). In other words, a voltage difference between the first and second electrodes of the second transistor T2 may be 0 V. Accordingly, the generation of an electric current by the second transistor T2 may be completely or substantially prevented.

In the second period t2, the sensing voltage Vs may be applied to the third node N3. In the second period t2, the third transistor T3 may be turned on by a sensing control signal, and the sensing voltage Vs supplied through the data line DLj may be provided to the third node N3 through the third transistor T3. The third node N3 may be charged with the sensing voltage Vs, and a voltage difference between the first and second electrodes of the second transistor T2 (i.e., the driving transistor) may be substantially 0 V. Thus, the second transistor T2 may be completely turned off. Since a first electrode of the organic light-emitting device EL is connected to the third node N3 and a second electrode of the organic light-emitting device EL is connected to a second power supply voltage ELVSS, a specific voltage difference may be created between both terminals of the organic light-emitting device EL. Accordingly, an electric current corresponding to this voltage difference may flow through the organic light-emitting device EL, causing the organic light-emitting device EL to emit light at a specific luminance level.

Next, compensated image data is generated (operation S120).

A sensor 160 may read out degradation information based on the sensing voltage Vs. In other words, sensing data SD may be detected using various suitable known methods. For example, the sensing data SD may be read out by measuring the luminance of the organic light-emitting device EL. However, the present invention is not limited thereto, and the sensing data SD may also be read out by measuring a current or voltage flowing through the organic light-emitting device EL. The sensor 160 may convert the read-out sensing data SD into a digital value. The digital value generated by each pixel PX may be mapped to a memory unit (or memory) and provided to a controller 120 as the sensing data SD. The controller 120 may generate compensated image data DATA1 by compensating image data DATA using the received sensing data SD. Specifically, an image compensator 123 may generate the compensated image data DATA1 by correcting the image data DATA such that a voltage increased by an amount corresponding to a luminance reduction caused by the degradation of the organic light-emitting device EL may be applied to a degraded pixel.

The method of driving the organic light-emitting display according to the current embodiment may prevent or reduce the generation of a leakage current by completely shutting off the second transistor T2 (i.e., the driving transistor). Accordingly, the degradation information of the organic light-emitting device EL may be read out more accurately based on the sensing voltage Vs, making more accurate data compensation possible.

Other components used in the method of driving the organic light-emitting display according to the current embodiment are substantially identical to those of the organic light-emitting display 10 of FIGS. 1 through 7 identified by the same names, and thus a detailed description thereof is omitted.

In some embodiments, in the applying of the sensing voltage included in the method of driving the organic light-emitting display, the first transistor T1 and the third transistor T3 may be turned on concurrently (e.g., simultaneously). In other words, a scan signal and a sensing control signal may be provided at the same or substantially the same time. Voltage levels of the gate electrode, the first electrode and the second electrode of the second transistor T2 (i.e., a driving transistor) may all be set to the level of the sensing voltage Vs. In the method of driving the organic light-emitting display according to the current embodiment, the driving transistor may be turned off by concurrently (e.g., simultaneously applying the same or substantially the same voltage to the gate electrode, the first electrode and the second electrode of the driving transistor. Therefore, the time required to apply the sensing voltage Vs may be reduced.

Embodiments of the present invention provide at least one of the following aspects.

It is possible to measure more accurate degradation information.

Accordingly, since more accurate degradation compensation may be performed, display quality may be improved.

However, the effects of the present invention are not restricted to the one set forth herein. The above and other effects of embodiments of the present invention will become more apparent to one of ordinary skill in the art to which the present invention pertains by referencing the claims.

While the present invention has been particularly shown and described with reference to exemplary embodiments thereof, it will be understood by those of ordinary skill in the art that various changes in form and detail may be made therein without departing from the spirit and scope of the present invention as defined by the following claims and their equivalents. The exemplary embodiments should be considered in a descriptive sense only and not for purposes of limitation.

What is claimed is:

1. An organic light-emitting display comprising:
- a first transistor comprising:
  - a gate electrode connected to a scan line;
  - a first electrode connected to a data line; and
  - a second electrode connected to a first node;
- a second transistor comprising:
  - a gate electrode connected to the first node;
  - a first electrode connected to a first power supply voltage; and
  - a second electrode connected to a third node;
- a third transistor comprising:
  - a gate electrode connected to a sensing control line;
  - a first electrode connected to the data line; and
  - a second electrode connected to the third node; and
- an organic light-emitting device comprising:
  - an anode connected to the third node; and
  - a cathode connected to a second power supply voltage,
- wherein the first power supply voltage is set to a level of a sensing voltage for a period of time during which the sensing voltage is provided to the data line.

2. The organic light-emitting display of claim 1, wherein a same voltage is applied to the gate electrode, the first electrode, and the second electrode of the second transistor.

3. The organic light-emitting display of claim 1, wherein the first transistor and the third transistor are configured to be turned on sequentially.

4. The organic light-emitting display of claim 1, wherein the first transistor and the third transistor are configured to be turned on concurrently.

5. The organic light-emitting display of claim 1, further comprising:
- a sensor configured to read out sensing data of the organic light-emitting device corresponding to the sensing voltage.

6. The organic light-emitting display of claim 5, further comprising:
- a controller configured to receive the sensing data from the sensor and to generate compensated image data by compensating an image signal received from an external source using the sensing data.

7. The organic light-emitting display of claim 6, further comprising:
- a power supply configured to output the first power supply voltage and the second power supply voltage.

8. The organic light-emitting display of claim 7,
- wherein the controller is configured to output driving signals for controlling the sensor and the power supply, and
- wherein the power supply comprises:
  - a switching device connected to a high-level supply terminal or a sensing-level supply terminal according to the driving signals received from the controller.

9. An organic light-emitting display comprising:
- a plurality of pixels, each pixel comprising:
  - an organic light-emitting device; and
  - a driving transistor comprising:
    - a first electrode connected to the organic light-emitting device; and
    - a second electrode;
- a sensor configured to read out degradation information of the organic light-emitting device by applying a sensing voltage of a specific level to a gate electrode and the first electrode of the driving transistor; and
- a power supply configured to supply a power supply voltage of a same level as that of the sensing voltage to the second electrode of the driving transistor.

10. The organic light-emitting display of claim 9, wherein each of the pixels further comprises:
- a control transistor configured to supply the sensing voltage to the gate electrode of the driving transistor; and
- a sensing transistor configured to supply the sensing voltage to the first electrode of the driving transistor.

11. The organic light-emitting display of claim 10, wherein the control transistor and the sensing transistor are configured to be turned on sequentially.

12. The organic light-emitting display of claim 10, wherein the control transistor and the sensing transistor are configured to be turned on concurrently.

13. The organic light-emitting display of claim 9, wherein the sensor is configured to read out sensing data of the organic light-emitting device corresponding to the sensing voltage.

14. The organic light-emitting display of claim 13, further comprising:
- a controller configured to receive the sensing data from the sensor and to generate compensated image data by compensating an image signal received from an external source using the sensing data.

15. The organic light-emitting display of claim 14, wherein the controller is configured to output driving signals for controlling the sensor and the power supply, and wherein the power supply comprises:

a switching device connected to a high-level supply terminal or a sensing-level supply terminal according to the driving signals received from the controller.

16. A method of driving an organic light-emitting display comprising:

a plurality of pixels, each pixel comprising:

an organic light-emitting device; and a driving transistor comprising:

a first electrode connected to the organic light-emitting device; and a second electrode, the method comprising:

reading out degradation information of the organic light-emitting device by applying a sensing voltage of a specific level to a gate electrode and the first electrode of the driving transistor; and generating compensated image data by compensating an image signal received from an external source using the degradation information, wherein a power supply voltage of a same level as that of the sensing voltage is supplied to the second electrode of the driving transistor in the reading out of the degradation information.

17. The method of claim 16, wherein each of the pixels further comprises:

a control transistor which supplies the sensing voltage to the gate electrode of the driving transistor; and a sensing transistor which supplies the sensing voltage to the first electrode of the driving transistor.

18. The method of claim 17, wherein the control transistor and the sensing transistor are turned on sequentially.

19. The method of claim 17, wherein the control transistor and the sensing transistor are turned on concurrently.

20. The method of claim 16, wherein compensated image data is generated by compensating an image signal received from an external source using sensing data corresponding to the degradation information of the organic light-emitting device.

* * * * *